United States Patent [19]

Stanger et al.

[11] 3,930,709

[45] Jan. 6, 1976

[54] ELECTRICAL CONNECTOR

[75] Inventors: Robert J. Stanger, Alpha; Larry N. Siebens, Great Meadows,, N.J.

[73] Assignee: Amerace Corporation, New York, N.Y.

[22] Filed: Mar. 10, 1975

[21] Appl. No.: 556,921

[52] U.S. Cl. ..... 339/111; 174/73; 200/144; 339/143 R

[51] Int. Cl.[2] ..... H01R 13/52

[58] Field of Search..... 339/111, 101, 60, 143 R; 200/144, 151; 174/73

[56] References Cited

UNITED STATES PATENTS 2,762,025 9/1956 Melcher ..... 339/143 R

*Primary Examiner*—Roy Lake
*Assistant Examiner*—DeWalden W. Jones
*Attorney, Agent, or Firm*—S. Michael Bender; Richard A. Craig; Gregory J. Battersby, Jr.

[57] ABSTRACT

An electrical connector includes complementary contact elements, one contact element being supported for axial movement in its housing as part of a contact assembly also including a piston and a member evolving arc-quenching gas upon being subjected to an arc. Such contact assembly is disposed in a passage having an encircling electrically conductive wall and a piston thereof is responsive to evolved gas to displace the contact assembly. A resilient contactor is situated radially outwardly of the contact assembly and radially inwardly of the conductive wall for resiliently engaging the contact assembly and wall for providing electrical continuity therebetween.

28 Claims, 4 Drawing Figures

ELECTRICAL CONNECTOR

FIELD OF THE INVENTION

This invention relates to electrical connectors and more particularly to separable electrical connectors suited for use under high voltage conditions.

BACKGROUND OF THE INVENTION

In recent years, the underground power distribution industry has come to recognize the desireability of employing separable connector arrangements involving complementary, interfitting members, one designated an elbow and supporting a pinshaped male contact element spaced coaxially interiorly of an encircling elastomeric shielded, insulated housing, and the other designated a bushing insert and having an elastomeric shielded, insulated housing including interiorly thereof a female contact element supported coaxially in the bushing housing for receiving the male contact element. In accommodating electrical stresses imposed in use and in permitting entrapment of air without deleterious ionization thereof, such separable connectors have since their inception incorporated structural features such as are shown in commonly-assigned U.S. Ruete et al. Pat. No. 3,243,756 and U.S. Ruete Pat. No. 3,344,391.

Elbows and bushings of the aforementioned type include elements fabricated of materials capable of evolving an arc-quenching gas upon being exposed to an electrical arc struck between the male and female contacts upon joinder and separation thereof. In the elbow, such material is in the form of a pinshaped pinshaped follower secured to the male contact element forwardly thereof. In the bushing, such material is in the form of a guide supported forwardly of the female contact element for receiving the follower. These well-known features are shown, for example, in commonly-assigned U.S. Brown Pat. No. 3,654,590, which discloses a prescribed axial spacing between the guide and its associated female contact element, such spacing being defined in relation to arc strike distance and being particularly remedial when the elbow and bushing are joined under a fault closure condition.

Some bushings in use presently are constructed with all parts thereof in fixed mutual positional relation, as described, for example, in the commonly-assigned U.S. Pat. to Ruete et al. No. 3,539,972. Recently, however, the industry has seen the development of bushings in which parts are movably supported and are responsive to arc-generated gas pressures in the bushing to be displaced in a manner intended to accelerate the engagement of conductive members to extinguish any arcs struck therebetween. In one such moving part bushing, as disclosed, for example, in U.S. Kotski Pat. No. 3,542,986, the female contact element is supported for axial movement by a piston against the head of which arc-generated gas is applied. Thus, a piston assembly is disposed for unitary movement in the bushing and includes such piston and female contact element and an insulative sleeve encircling the female contact element and supporting the aforementioned guide. Whereas electrical continuity from the female contact element to the exteriorly accessible bushing terminal, is attained in the fixed part bushing simply by fixedly connecting the female contact element to the bushing terminal, the Kotski-type of moving part bushing employs a flexible electrical cable connected at one end thereof to the piston (which is in turn electrically connected to the female contact element) and at its other end to the bushing terminal.

In another version of moving part bushing, described in Joy Manufacturing Company Bulletin 215-4, January 1972, the bushing terminal fixedly supports the bushing female contact element, as in the fixed part bushings. A piston assembly encircles the female contact element and is axially movable thereon. The piston assembly supports and is electrically connected to a so-called arcing ring which is disposed forwardly of the female contact element so as to be disposed to engage the male contact element in the course of its travel to the female contact element. Valve means tightly encircling the female contact element rearwardly of the piston assembly is opened by arc-generated gas evolved under fault closure conditions and the gas displaces the piston assembly and hence the arcing ring to accelerate engagement thereof with the male contact element to extinguish an arc struck therebetween.

In a third type of moving part bushing, set forth in copending commonly-assigned application Ser. No. 406,281, filed on Oct. 15, 1973 on behalf of applicants herein, the first-mentioned type of moving part bushing is modified by introduction therein of a valve member transversely of the bore of the piston supporting the movable female contact element and the further introduction of a spring member exerting rearward axial force on the piston assembly and compressible upon forward piston assembly movement. The spring member serves to enhance rapid separation of the contact elements upon withdrawal of the male contact element from the bushing. Thus, upon separation of the male contact element from frictional engagement with the guide and female contact element, the piston assembly is spring-driven rearwardly of the forwardly exiting male contact element to quickly stretch and therefore aid in extinguishing the arc struck therebetween.

With respect to both functional capability and structural simplicity, the first- and third-mentioned types of moving part bushings are superior to the second-mentioned type. In this regard, the Joy piston assembly defines lesser piston head area than the Kotski piston head, since the former can be of no greater expanse than the limited annular space between its female contact element and the housing. Further, the reliance of the Joy arrangement on sliding engagement of the piston assembly on the female contact element for electrical continuity is less desirable than the substantially constant electrical continuity provided by the flexible cable of the Kotski-type bushing.

Despite the apparent solution to fault closure bushing problems in the fixed part bushing and in the Kotski-type moving part bushing, both bushings have disadvantages. The fixed part bushing is clearly not favored where it is desired to render fault closure somewhat independent of operator performance, as is provided by the moving part bushing. On the other hand, as mentioned above, the Kotski-type moving part bushing requires the flexible cable which acts undesirably as a baffle in a pressure conduit, occupies bushing axial extent otherwise usable for increasing piston stroke, is exposed to the destructive action of arcing and may become self-entangled, impeding piston movement. Furthermore, in manufacture, the flexible cable requires two joinder steps, one end to the piston and the other end to the bushing terminal, and such steps require considerable care in practice.

SUMMARY OF THE INVENTION

This invention has as its object the provision of improved moving part bushings suited for use as a high voltage separable connector.

A more particular object of the invention is to provide for simplifying the manufacture and for enhancing the functional capability of bushings having female contact elements supported for axial movement therein.

In attaining the foregoing and other objects, the invention provides, in a preferred bushing housing embodiment, an electrically conductive hollow cylinder defining an axial passage or bore in the bushing housing, a female contact assembly movable axially in such passage and including a piston supporting for joint movement therewith both a female contact element electrically connected thereto and a gas-evolving guide, and a contactor element disposed in encircling relation to the female contact assembly and axially movable therewith, such contactor element having resilient contact fingers extending inwardly for engagement with the female contact assembly and extending outwardly for engagement with the inner wall of the conductive cylinder, whereby electrical connection of substantially fixed resistance is provided between the cylinder and the female contact element throughout axial movement thereof.

In its preferred form, the bushing of the invention includes a terminal fixedly supported in the housing and mechanically and electrically secured to the conductive cylinder and provides for encirclement of the piston by the contactor element, with the piston in turn mechanically and electrically secured to the female contact element. Bushing construction in accordance with the invention retains the advantageous characteristics inherent in the Kotski-type moving female contact element bushing, e.g., increased piston head area, and at the same time, in eliminating the need for the flexible cable thereof, averts the need for heat joinder steps in manufacture, the baffling of gas pressure by such cable, and possible entanglement of the cable, and effects various quite unexpected operational advantages discussed hereinafter.

The foregoing and other objects and features of the invention will be made further evident from the following detailed description of the presently preferred embodiment thereof and from the drawings wherein like reference numerals are employed throughout for identification of like parts.

DESCRIPTION OF THE PREFERRED EMBODIMENT

Figure 1:
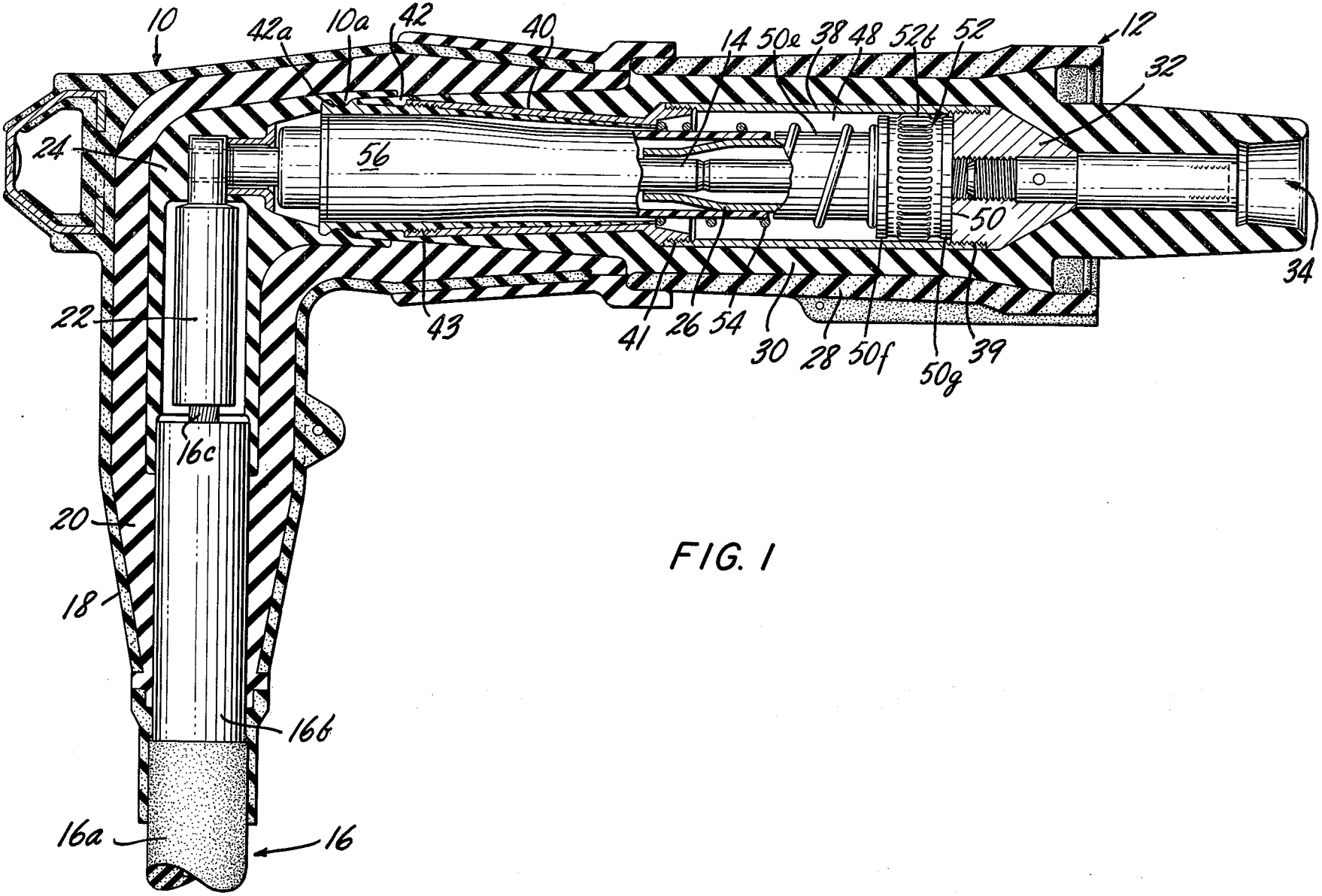
FIG. 1 is a side elevation, partly in section, of electrical connector apparatus constructed in accordance with the invention.

Referring to FIG. 1, the connector apparatus therein includes elbow and bushing connectors respectively including separable housings 10 and 12, telescopically interfittable to provide a water-tight seal therebetween. Housing 10 includes therewithin pin-shaped male contact element 14 and is of configuration including a first end opening for receiving electrical cable 16 and an opposite end opening beyond which contact element 14 extends. Such housing 10 includes an outer conductive sleeve member 18 and an inner insulative sleeve member 20, sleeve members 18 and 20 being constructed of elastomeric material and arranged in a manner more fully described in the above-referenced 3,243,756. Sleeve member 18 thus preferably resiliently engages both shield **16*a* of cable 16 and cable insulation 16*b* and sleeve member 20 resiliently engages cable insulation 16*b*. Cable conductor 16*c* is secured in a ferrule 22 or the like in which contact element 14 is threadably insertable. In the interior of housing 10 a further conductive elastomeric member 24** is arranged in accordance with the above-referenced U.S. Pat. No. 3,344,391 to guard against undesired ionization if air entrapped within the housing interior.

Housing 12 includes female contact element 26 for receiving male contact element 14 and is generally fixedly secured to a suitable electrical apparatus such as, for example, a distribution transformer with housing 10 being moved into and out of engagement with housing 12. Housing 12 includes an outer sleeve member 28 comprised of conductive elastomeric material and an inner sleeve member 30 comprised of insulative elastomeric material. A conductive bushing terminal 32 is secured in sleeve member 38 and, by electrical connection of terminal 32 to the female contact assembly located interiorly of the bushing as will be more fully discussed below, completes an electrical circuit with cable 16 through housing 10 when housings 10 and 12 are interfitted substantially as shown in FIG. 1. As is well known, a suitable apparatus such as the aforementioned distribution transformer may be connected by means of a threaded stud or terminal (not shown) adapted to be secured to terminal 32 through opening 34 of housing 12 so as to complete a selectively disconnectable electrical circuit between the apparatus and cable 16. A conductive metallic cylindrical sleeve 38 is disposed interiorly of elastomeric insulative sleeve member 30 and is threadably secured to terminal 32 or otherwise electrically connected thereto as at 39.

Figure 2:
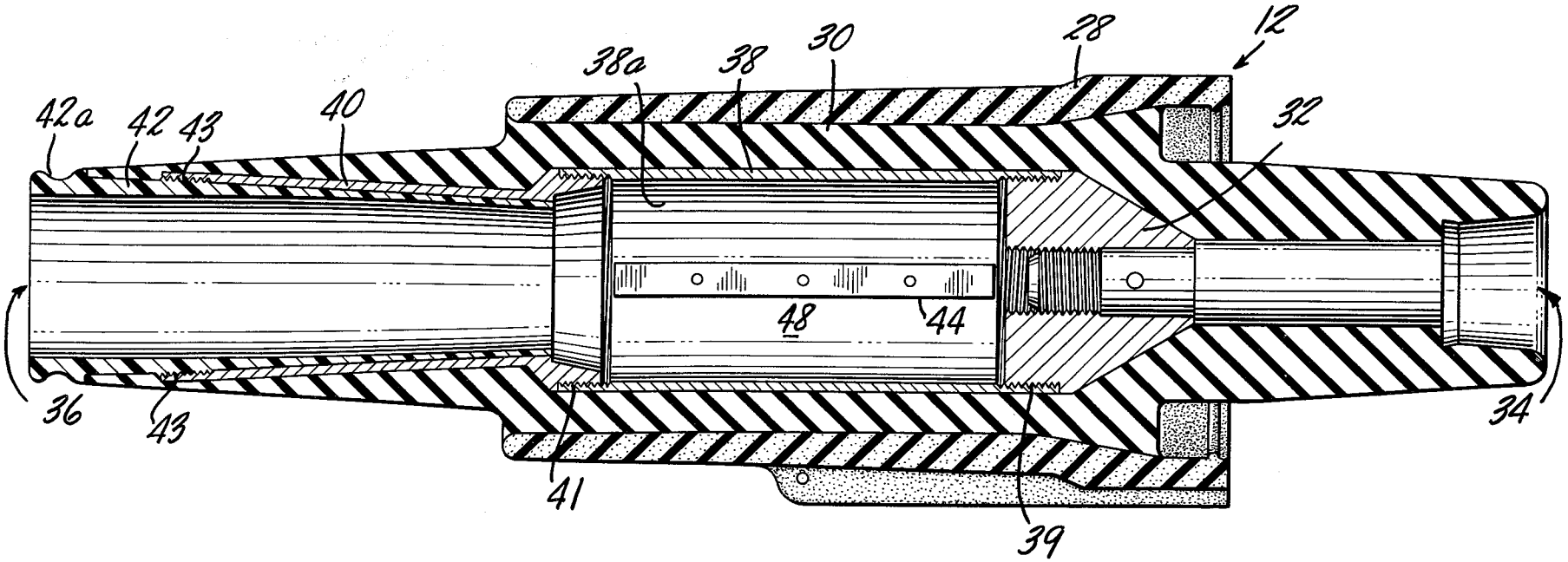
FIG. 2 is a sectional view of the housing of the female connector of the FIG. 1 apparatus.

In FIG. 2, housing 12 is shown without its female contact assembly and will be seen to define an axial passage extending therethrough from end opening 34 to end opening 36. Conductive cylindrical sleeve 38 is further threadedly secured to conductive member 40 as at 41 which in turn is threadably secured at its opposite end to bushing insulative nosepiece 42, as at 43, the nosepiece 42 having an encircling grooved portion **42*a* serving as a securing detent for a complementary ribbed portion 10*a* of housing 10 (FIG. 1). Cylindrical sleeve 38 supports on its inner cylindrical wall 38*a* an axially extending key 44** substantially as shown.

Figure 3:
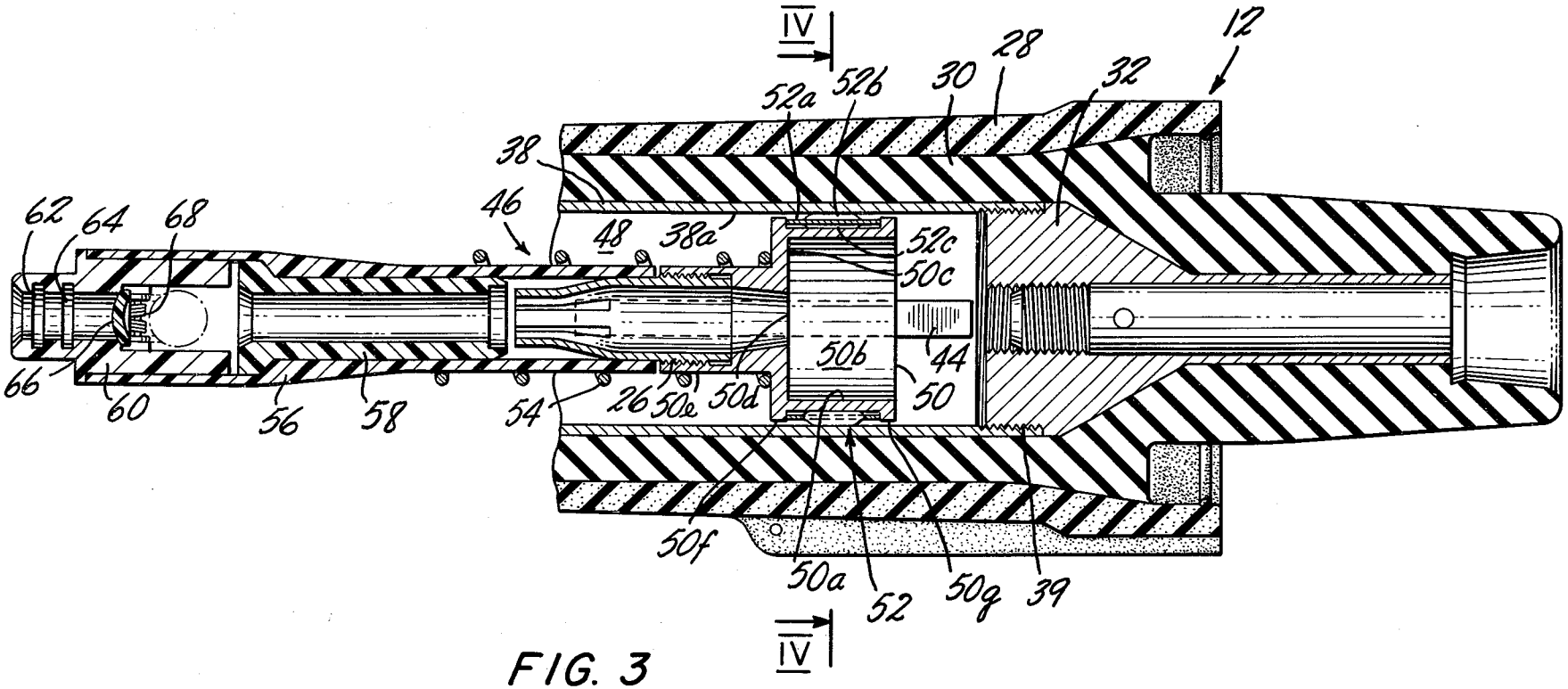
FIG. 3 is a sectional-view of the female connector of the FIG. 1 apparatus, the leading portion of its housing being omitted for clarity.

Referring now to FIG. 3, female contact assembly 46 is disposed for movement within the axial passage of housing 12 and, more particularly, within bore 48 encircled by the inner wall surface **38*a* of sleeve 38. Assembly 46 includes a piston 50 having depending skirt portion 50*a* with an interior recess 50*b* and a piston head 50*c*, the latter being centrally open as at 50*d*. Leftwardly (forwardly) of head 50*c*, the piston includes socket 50*e* having a partially threaded interior recess communicating freely with piston interior 50***b* through piston head opening 50*d*. Piston depending shirt portion 50*a* supports on its exterior surface a contactor element 52 in the form of a so-called "louvered" contact, such as is illustrated in U.S. Neidecker Pat. No. 3,453,587, U.S. Crabbs Pat. No. 2,217,473 and copending commonly-assigned application Ser. No. 503,783 filed on Sept. 6, 1974, the subject matter of the latter application being hereby incorporated herein by this reference. Such contacts typically comprise an elongate conductive strip member 52*a* having transversely extending expanses thereof bent or twisted with respect to the strip member so as to provide resilient contact fingers 52*b* and 52*c* for engaging surfaces spaced from opposite sides of the strip member. In the instant preferred embodiment, fingers 52*b* engage the interior of cylindrical sleeve 38 and fingers 52*c* engage the exterior of piston depending skirt portion 50*a*. Depending skirt portion 50*a* provides spaced radially extending projections 50*f* and 50*g* which define an annular recess within contact 52 is axially restrained relative to piston 50, thus assuring joint axial movement thereof with female contact assembly 46.

Figure 4:
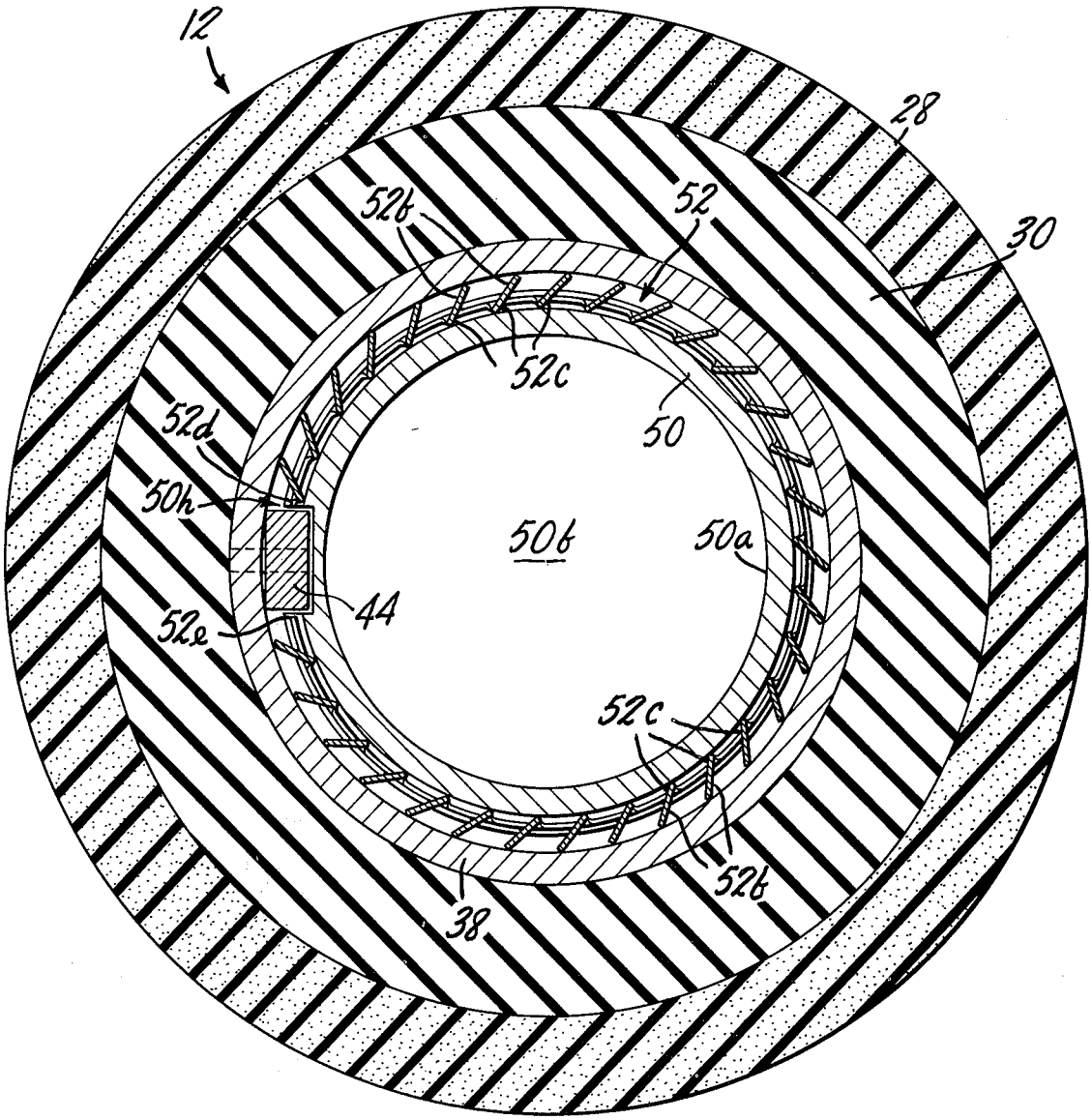
FIG. 4 is a cross-sectional view as seen from plane IV—IV of FIG. 3.

Referring to FIG. 4, contactor element 52 will be seen to encircle the depending skirt portion 50*a* to an extent less than 360°, ends 52*d* and 52*e* of the strip member of the contactor element being spaced from one another to permit seating of key 44 in piston slot 50*h*. Such slot and key arrangement serves to prevent rotation of piston 50 relative to housing 12, thereby facilitating threaded engagement in piston nose 50*e* of the remainder of the female contact assembly, discussed below. As is also shown in FIG. 4, contact fingers 52*b* and 52*c* are of dissimilar length, fingers 52*b* extending further outwardly from strip member 52*a* than fingers 52*c*. Such preferred finger arrangement is of the type disclosed in above-referenced patent application Ser. No. 503,783 to which reference may be had for extended discussion of the advantages of such arrangement.

Returning again to FIG. 3, piston nose 50*e* is receivably engaged within one end of helically wound compression spring 54, the outer diameter of the nose being sufficiently reduced with respect to the diameter of skirt portion 50*a* to permit suitable radial spacing between spring 54 and key 44. To the left of spring 54 in FIG. 3 is shown the remainder of the female contact assembly, comprising a rigid tubular sleeve 56 of a suitable insulative material such as for example, laminated or wound glass filament preferably with the grain thereof extending axially, secured as by an adhesive (and a pair of brass pins not shown) to female contact element 26 short of the rightward exteriorly threaded part of the contact element. Sleeve 56 supports therewithin a guide 58 comprised of material evolving arc-quenching gas upon being subjected to an arc struck between the male and female contact elements. Such guide defines an interior cylindrical bore for receiving and guiding the male contact element toward and into engagement with the female contact element. Leftwardly of guide 58, sleeve 56 supports a valve housing assembly 60 comprised of a suitable insulative material, preferably a polymeric material such as a high molecular weight polyoxymethylene, sold commercially under the trademark Delrin, and supporting sealing rings 62 and 64 and a flapper valve 66 biased into a closed position by spring 68 such that the interior of the female contact assembly is isolated upon withdrawal of the male contact element therefrom. The employment and construction of such sealing rings and flapper valve are well known in the art.

As will be appreciated, female contact assembly 46 includes a through-conduit extending into piston interior recess 50*b* such that arc-generating gases may gain access thereto and propulsively react upon piston head 50*c* to advance piston 50 leftwardly in FIG. 3 and hence to direct female contact element 26 into engagement with the male contact element. In contrast to the Kotski-type moving part bushing, the conduit provided for arc-evolved gas in the bushing of the invention is unobstructed throughout the chamber defined in part by interior recess 50*b* rearwardly of piston head 50*c*, that is, free of gas-baffling elements, such as flexible cables. Forward propulsion of the female contact assembly is enhanced accordingly and more efficient gas-assisted contact element closure is desirably effected, especially under fault closure conditions.

Of great concern in bushing usage is the escape of ionized gas attending withdrawal of the male contact element on loadbreak, i.e., separation of the male and female contact elements under normal load conditions. Such escaping gas forms a conductive path exteriorly of the bushing which can cause flashover between the then energized male contact element and neighboring conductive grounded structure. In a quite unexpected performance characteristic, bushings constructed in accordance with the invention serve to decrease ionized gas escapement. It is hypothecated that one reason for this is that the piston radial projections 50*f* and 50*g* function to baffle ionized gas moving forwardly under increasing gas pressure between the piston and cylinder 38. Further, contact fingers 50*b* and 52*c* seated in such well are believed to deionize such ionized gas, by functioning as cooling fins therefor. It is believed furthermore that the contactor elements, such as discussed above, enable higher current capacity bushings than do the previous flexible cable arrangement within the same bushing volume.

In accordance with a further feature of the invention, tubular sleeve 56 (FIG. 3) tapers radially along progressive axial extents thereof gradually and without radial step discontinuities. The same is true of the inner surface of nosepiece 42 which encircles sleeve 56. This arrangement has been found to avert deleterious electrical stress concentrations giving rise to axially-directed burn-through, particularly of sleeve 56.

Various changes and modifications to the particularly disclosed embodiment will now be apparent to those skilled in the art and evidently may be made without departing from the spirit or scope of the invention. By way of example, the male contact element may equally well be supported for axial movement in its housing by practice of the invention. Similarly, resilient contactors other than the particularly disclosed louvered contact may be employed. Piston and other structure may likewise be varied. Accordingly, the particularly disclosed embodiment is intended in an illustrative and not in a limiting sense. The true spirit and scope of the invention is set forth in the appended claims.

What is claimed is:

1. In a first connector housing for use in connecting or disconnecting an energized high voltage circuit by engagement or disengagement with a second connector housing, said second housing supporting a first contact element, said first housing having an axial passage including an electrically conductive surface fixedly secured within said first housing, the invention comprising in combination:

a. a contact assembly disposed in said passage and including 1. a second contact element for engaging said first contact element, 2. guide means for guiding said first contact element for movement toward said second contact element and for evolving arc-quenching gas in response to an arc being struck between said first and second contact elements, and 3. piston means responsive to such evolved gas for jointly displacing said guide means and said second contact element toward said first contact element; and b. contactor means movable in said passage jointly with said contact assembly and disposed radially between said contact assembly and said first housing conductive surface for resiliently engaging said contact assembly and said first housing conductive surface for providing electrical continuity therebetween.

2. The invention claimed in claim 1 further including means for resiliently biasing said contact assembly axially inwardly in said first housing.

3. The invention claimed in claim 1 wherein said contactor means comprises an electrically conductive strip member having resilient fingers extending therefrom into engagement with said contact assembly and said first housing conductive surface.

4. The invention claimed in claim 3 wherein said piston means includes an electrically conductive piston mechanically and electrically connected to said second contact element, said contactor means fingers resiliently engaging said piston.

5. The invention claimed in claim 4 wherein said piston includes a forward socket portion receiving and supporting said second contact element and a depending portion defining an interior recess extending rearwardly from said socket portion, said socket portion, said second contact element and said guide means defining a conduit for said evolved gas, said interior recess communicating with said conduit.

6. The invention claimed in claim 4 wherein said depending portion includes a circumferentially exterior surface having radial projections at opposite axial ends, said contactor means being disposed axially between said projections and thereby restrained against axial movement relative to said contact assembly.

7. The invention claimed in claim 3 wherein said strip member includes first resilient contact fingers extending therefrom and engaging said first housing conductive surface and second resilient contact fingers extending therefrom and engaging said contact assembly, said first fingers being of greater extending length from said strip member than said second fingers.

8. The invention claimed in claim 1 wherein said contact assembly further includes an insulative member secured to said second contact element and fixedly supporting said guide means.

9. The invention claimed in claim 8 wherein said contact assembly further includes a nosepiece member supported by said insulative member forwardly of said guide means, said nosepiece member incorporating a valve openable by said first contact element upon insertion thereof in said second housing and closeable upon withdrawal of said first contact element from said second housing.

10. The invention claimed in claim 8 wherein said second housing includes an electrically conductive member defining said conductive wall and an insulative sleeve extending axially forwardly of said conductive member in encircling relation to said tubular member, said insulative sleeve and said tubular member tapering radially over progressive axial extents thereof without radial step discontinuities.

11. In a female connector housing for use in connecting or disconnecting an energized high voltage circuit by engagement or disengagement with a complementary male connector housing having a male contact element, the combination comprising:

a. a conductive member fixedly disposed in said female connector housing and having an inner wall defining a passage in said housing;

b. a female contact assembly disposed in said passage and including 1. a female contact element for engaging said male contact element, 2. guide means for receiving and guiding said male contact element for movement toward said female contact element and for evolving arc-quenching gas in response to an arc being struck between said male contact element and said female contact element during said movement, and 3. piston means responsive to such evolved gas for jointly displacing said guide means and said female contact element toward said male contact element; and c. contactor means movable in said passage jointly with said female contact assembly, said contactor means having inwardly extending conductive finger means for resiliently engaging said female contact assembly and outwardly extending finger means for engaging said inner cylindrical wall of said conductive member for providing electrical continuity between said female contact assembly and said conductive member.

12. The invention claimed in claim 11 further including means for resiliently biasing said female contact assembly axially inwardly in said female connector housing.

13. The invention claimed in claim 11 wherein said piston means includes an electrically conductive piston mechanically and electrically connected to said female contact element, said contactor means fingers resiliently engaging said piston.

14. The invention claimed in claim 13 wherein said piston includes a forward socket portion receiving and supporting said female contact element and a depending portion extending rearwardly from said socket portion, and having an interior recess, said socket portion, said female contact element and said guide means defining a conduit for said evolved gas, said interior recess communicating with said conduit.

15. The invention claimed in claim 14 wherein said depending portion includes a circumferentially exterior surface having radial projections at opposite axial ends, said contactor means being disposed axially between said projections and thereby restrained against axial movement relative to said female contact assembly.

16. The invention claimed in claim 11 wherein said strip member includes first resilient contact fingers extending therefrom and engaging said conductive member inner wall and second resilient contact fingers extending therefrom and engaging said female contact assembly, said first fingers being of greater extending length from said strip member than said second fingers.

17. The invention claimed in claim 11 wherein said female contact assembly further includes an insulative tubular member secured to said female contact element and fixedly supporting said guide means.

18. The invention claimed in claim 17 wherein said female contact assembly further includes a nosepiece member supported by said tubular member forwardly of said guide means, said nosepiece member incorporating a valve openable by said male contact element upon insertion thereof in said female connector housing and closeable upon withdrawal of said male contact element from said female connector housing.

19. The invention claimed in claim 17 wherein said female connector housing includes an insulative sleeve extending axially forwardly of said conductive member in encircling relation to said tubular member, said insulative sleeve and said tubular member tapering radially over progressive axial extents thereof without radial step discontinuities.

20. A female connector for use in connecting or disconnecting an energized high voltage circuit by engagement or disengagement with a complementary male connector having a male contact element, said female connector comprising:

a. a housing having first and second open ends and an axially extending passage therebetween;

b. terminal means accessible exteriorly of said housing and closing said housing first open end;

c. a conductive member fixedly disposed in said housing passage and electrically connected to said terminal means and having an inner cylindrical wall defining a bore coaxial with said housing passage;

d. a female contact assembly in said housing passage including 1. piston means axially movable in said conductive member bore and having a head disposed in facing relation to said terminal means, 2. a female contact element electrically connected to and movable with said piston means and disposed in facing relation to said housing second open end for engaging said male contact element, and 3. guide means movable with said piston means for receiving and guiding said male contact element for movement toward said female contact element and for evolving arc-quenching gas in response to an arc being struck between said male contact element and said female contact element during said movement, said piston means, said female contact element and said guide means defining a conduit therethrough for conveying said gas between said piston means head and said terminal means whereupon said piston means is operative to forcibly move said female contact element into engagement with said male contact element, and e. contactor means having inwardly extending conductive finger portions engaging said piston means and outwardly extending finger portions engaging said inner cylindrical wall of said conductive member for providing electrical continuity between said female contact element and said terminal means.

21. The invention claimed in claim 20 further including means for resiliently biasing said female contact assembly axially inwardly in said housing.

22. The invention claimed in claim 21 wherein said piston means includes an electrically conductive piston mechanically and electrically connected to said female contact element, said contactor means fingers resiliently engaging said piston.

23. The invention claimed in claim 22 wherein said piston includes a forward socket portion receiving and supporting said female contact element and a depending portion extending rearwardly from said socket portion and defining an interior recess, said socket portion, said female contact element and said guide means defining a conduit for said evolved gas, said interior recess communicating with said conduit.

24. The invention claimed in claim 22 wherein said depending portion includes a circumferentially exterior surface having radial projections at opposite axial ends, said contactor means being disposed axially between said projections and thereby restrained against axial movement relative to said contact assembly.

25. The invention claimed in claim 21 wherein said contactor means comprises a strip member including first resilient contact fingers extending therefrom and engaging said conductive member wall and second resilient contact fingers extending therefrom and engaging said female contact assembly, said first fingers being of greater extending length from said strip member than said second fingers.

26. The invention claimed in claim 21 wherein said female contact assembly further includes an insulative tubular member secured to said female contact element and fixedly supporting said guide means.

27. The invention claimed in claim 26 wherein said female contact assembly further includes a nosepiece member supported by said tubular member forwardly of said guide means, said nosepiece member incorporating a valve openable by said male contact element upon insertion thereof in said housing and closeable upon withdrawal of said male contact element from said housing.

28. The invention claimed in claim 26 wherein said housing includes an insulative sleeve extending axially forwardly of said conductive member in encircling relation to said tubular member, said insulative sleeve and said tubular member tapering radially over progressive axial extents thereof without radial step discontinuities.

* * * * *

UNITED STATES PATENT AND TRADEMARK OFFICE

CERTIFICATE OF CORRECTION

PATENT NO. : 3,930,709

DATED : January 6, 1976

INVENTOR(S) : Robert J. Stanger and Larry N. Siebens

It is certified that error appears in the above-identified patent and that said Letters Patent are hereby corrected as shown below:

Column 8, line 4, after "conductive" insert --tubular--; line 5, change "said" to --a--; line 6, change "extending" to --extends--; line 7, change "tubular" to --insulative--; line 8, change "tubular" to --insulative--; line 38, delete "cylindrical"; line 66, before "strip" insert --connector means comprises an electrically conductive--; and line 66, change "includes" to --having--.
Column 10, line 26, change "depending portion" to --piston--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 3,930,709

DATED : January 6, 1976

INVENTOR(S) : Robert J. Stanger and Larry N. Siebens

It is certified that error appears in the above-identified patent and that said Letters Patent are hereby corrected as shown below:

Column 5, line 6, change "2,217,473" to --2,217,433--.

Signed and Sealed this

*Tenth* Day of *June 1980*

[SEAL]

*Attest:*

SIDNEY A. DIAMOND

*Attesting Officer*

*Commissioner of Patents and Trademarks*